United States Patent [19]

Kisler

[11] Patent Number: 4,513,683

[45] Date of Patent: Apr. 30, 1985

[54] COATING UNIFORMITY IMPROVEMENT APPARATUS

[75] Inventor: Semyon Kisler, W. Newton, Mass.

[73] Assignee: Polaroid Corporation, Cambridge, Mass.

[21] Appl. No.: 481,850

[22] Filed: Apr. 4, 1983

Related U.S. Application Data

[63] Continuation of Ser. No. 222,334, Jan. 5, 1981, abandoned.

[51] Int. Cl.[3] ..... B05B 5/02; B05C 5/00

[52] U.S. Cl. ..... 118/620; 118/621; 118/626; 118/638; 361/212; 361/221

[58] Field of Search ..... 118/620, 621, 626, 638; 250/324, 325, 326; 361/212, 221, 229

[56] References Cited

U.S. PATENT DOCUMENTS

| | | | |
|---|---|---|---|
| 2,774,921 | 12/1956 | Walkup | 250/325 |
| 3,196,270 | 7/1965 | Rosenthal | 250/324 |
| 3,474,292 | 10/1969 | Carter | 361/213 |
| 3,484,275 | 12/1969 | Lewicki | 427/10 |
| 3,591,403 | 7/1971 | Sheehan | 118/638 |
| 3,653,758 | 4/1972 | Trimmer et al. | 118/621 |
| 3,671,806 | 6/1972 | Whitmore et al. | 317/2 R |
| 3,702,258 | 11/1972 | Gibbins et al. | 118/638 |
| 3,729,648 | 4/1973 | Kerr | 317/2 R |
| 4,086,872 | 5/1978 | Pan | 118/638 |
| 4,088,093 | 5/1978 | Pan | 118/638 |

OTHER PUBLICATIONS

"Controlling Polar Charge With Low Electrical Potentials", p. 70, Research Disclosure, Feb. 1980.

*Primary Examiner*—Sadie L. Childs

*Attorney, Agent, or Firm*—John J. Kelleher

[57] ABSTRACT

Apparatus for improving the uniformity of a wet coating applied on a charge-retaining base material, said apparatus comprising charging means for producing an electric field between said coating and said base material while said coating remains in an essentially wet state.

11 Claims, 4 Drawing Figures

COATING UNIFORMITY IMPROVEMENT APPARATUS

This is a continuation of application Ser. No. 222,334, filed Jan. 5, 1981, now abandoned.

BACKGROUND OF THE INVENTION

1. Field of the Invention

The present invention relates to a method and apparatus for improving the uniformity of a coating material after it has been applied to a charge-retaining material, in general, and to such apparatus for improving the uniformity of a coating material that has been applied to a moving web of such material, in particular.

2. Description of the Prior Art

In the manufacture of various coated products, it is often essential that coating materials applied to such products be of uniform thickness and/or have a smooth or planar surface. In, for example, the continuous manufacture of coated photographic sheet material, a nonuniform thickness coating applied to a moving web of such material would require considerably more drying time for drying the thicker portions of said nonuniform coating than would be required for drying the thinner portions of said nonuniform coating. In addition, a temperature gradient that is optimum for drying said thicker coating portions is often excessive for optimum drying of said thinner coating portions. Drying time is usually the major factor limiting maximum production rates of many coated products. Also, many properties of photographic film such as sensitivity to light, color saturation, etc., for example, can be adversely affected when constructed with nonuniformly coated sheet materials.

Mechanical devices generally employed in the web coating art, such as doctor blades, scrapers and the like, have controlled the uniformity of web coating thickness to a limited degree. However, in the production of photographic film, for example, such contact devices have a propensity for inducing surface defects in the film coatings and in addition, these contact devices very often have a detrimental effect on the sensitometry of a finished photographic film product.

One of the most effective coating thickness control techniques in present day use in the coating industry involves the employment of an electrostatic field to assist in the uniform deposition of coating materials on products to be coated. In the production of photographic film, for example, a web or sheet of material to be coated is passed between an electrically conductive support or backing roller and a coating applicator from which coating materials can flow onto a particular surface of said web. An electrostatic field is established across the gap between the coating applicator and said backing roller by a high voltage power supply whose output terminals are connected between said applicator and said roller. The electrostatic field in said coating causes a coating of uniform thickness to be deposited on a particular web surface. The magnitude of the voltage established between said applicator and said roller is normally less than that required to generate corona, but often exceeds 3KV DC.

In patent application Ser. No. 222,331, filed in the name of S. Kisler, et al., and on the same date as the present application, now U.S. Pat. No. 4,457,256, an electrostatic coating-gap assist method and apparatus are described wherein an electrostatic charge is placed on material to be coated prior to and/or when said material is remote from the gap wherein the actual coating operation takes place. A relatively intense electrostatic field is produced between the electrostatically charged material to be coated and an electrically conductive reference member connected to a low or ground potential as said electrostatically charged material is moved through the coating gap between a support or backing roller and in close proximity to said reference member for coating purposes. The reference member may be formed by the applicator, the coating fluid or by a completely separate member. The electrostatic field causes a coating layer of uniform thickness to be deposited on the material to be coated across a wide range of coating gaps without presenting an explosion or shock hazard to personnel, and without causing damage to or being subject to interruptions by imperfections in the material to be coated.

Electrostatic fields utilized in a manner such as those described above can greatly improve the thickness and/or surface uniformity of a layer of coating material. However, the use of an electrostatic field for coating improvement purposes will often cause changes in coating properties such as surface tension and/or the residual electrostatic charge on the material to be coated, that can limit the extent to which coating uniformity can be improved with an electrostatic field. Electrostatic charges present on a coated material, or coating fluid on a coating material having an electrostatic field related change in such properties as surface tension, etc., for whatever reason or reasons, can also limit the extent to which the uniformity of a coating material can be improved.

SUMMARY OF THE INVENTION

In accordance with the teachings of the present invention, a method and apparatus are provided for substantially improving the coating uniformity of an electrically conductive coating material that has been applied to a material to be coated. After the coating material has been applied to said material and while said material is still in its fluid state, the coated material is subjected to an electric field established between a high voltage electrode and said electrically conductive coating material.

DESCRIPTION OF THE PREFERRED EMBODIMENTS

Figure 1:
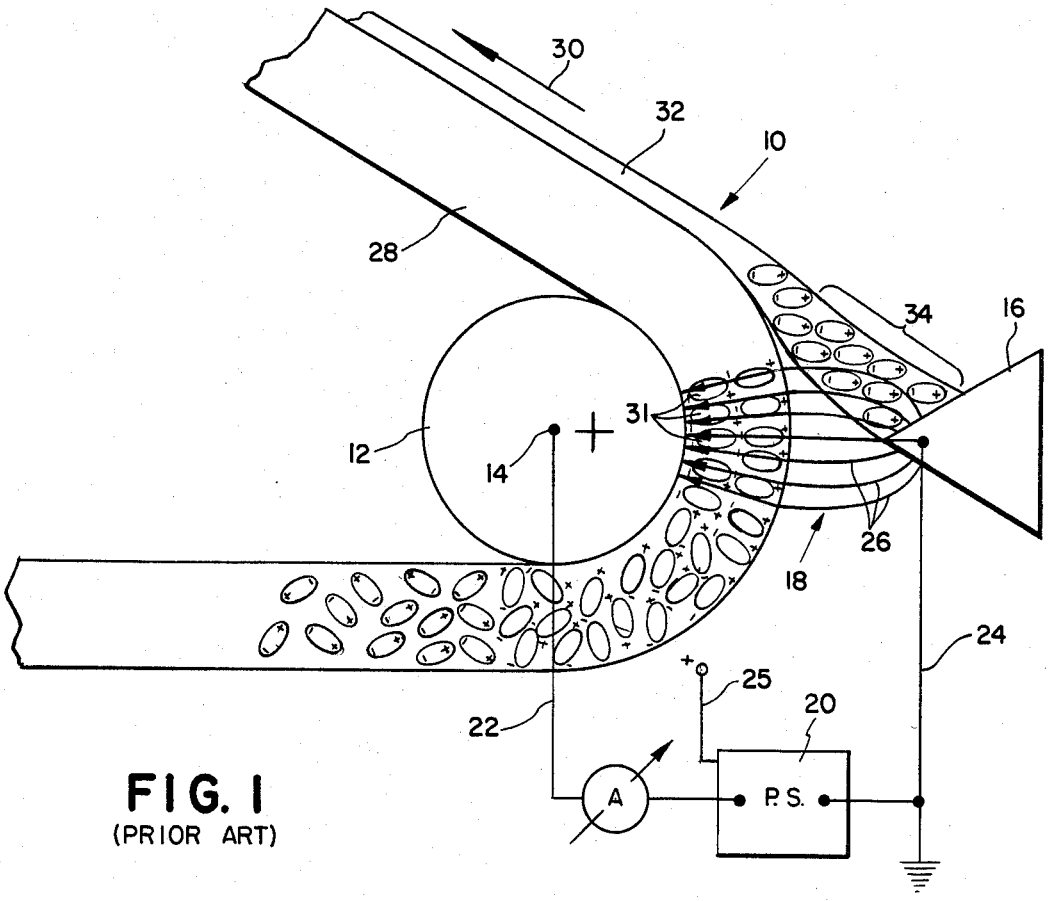
FIG. 1 (PRIOR ART)
FIG. 1 is a schematic diagram of web coating apparatus employing a conventional high voltage electrostatic coating-gap assist technique in accordance with the teachings of the prior art.

The present invention is directed to means for reducing the detrimental effects on coating uniformity produced by electrostatic charges remaining on a coated material. These residual-type charges can be produced in several ways. In the coating industry, for example, electrostatic fields are employed to improve coating uniformity with a satisfactory though limited degree of success. While coating uniformity is substantially improved with an electrostatic field, the residual electrostatic charges remaining on the coated material limit the extent of said improvement. Electrostatically assisted coating apparatus typical of that in present use in the coating industry is schematically illustrated in FIG. 1. In FIG. 1, numeral 10 generally indicates coating apparatus employing conventional electrostatic coating-gap assist apparatus constructed in accordance with the teaching of the prior art. Web support or backing roller 12 is cylindrically shaped, is electrically conductive and is mounted for rotation about backing roller axis 14. Coating applicator 16 is mounted in a fixed position with respect to backing roller 12 and is spaced from said roller 12 by a distance or gap 18. High voltage power supply 20, having a DC voltage across its output terminals that is often in the neighborhood of several thousand volts, has said output terminals connected between backing roller 12 and applicator 16 through paths 22 and 24, respectively. Because the coating fluid supplied by applicator 16 is electrically conductive, it often maintains said applicator 16 at or near ground potential through a coating-fluid-supplying conduit (not shown), the high voltage terminal of power supply 20 is necessarily connected to said roller 12 and the low voltage terminal of said supply 20 is connected to said grounded applicator 16.

When power supply 20 is energized through path 25, electrostatic field 26 is produced in coating gap 18 between high potential backing roller 12 and grounded applicator 16. As charge-retaining web 28 is moved in direction 30 through gap 18 by drive means (not shown), said web 28 is electrostatically charged by orienting its dipoles (such as by orienting dipoles 31) by said electrostatic field 26. Electrostatic charges produced on web 28 by electrostatic field 26 cause fluid 32 flowing from applicator 16 into coating gap 18 to be attracted toward and uniformly deposited on moving web 28.

An extremely important factor in the web coating process is the maintainance of an appropriate amount of coating material 32 in gap 18 for proper web-coating purposes. This portion of the coating material 32 is sometimes referred to as a coating fluid bead and is designated numeral 34 in prior art FIG. 1. The surface of web 28 normally moves faster than the rate at which coating fluid 32 flows onto said web 28 surface. This being so, as web 28 and fluid 32 in the form of bead 34 are brought into contact with one another, the faster moving web 28 pulls and thereby stretches said fluid 32 causing the thickness of coating fluid 32 to be reduced to a desired intermediate level. It is believed that electrostatic field 26 changes properties of coating fluid 32 such as surface tension, thereby allowing said fluid 32 to be stretched to a greater degree and over a larger gap between web 28 and applicator 16 without losing (breaking) bead 34 than would be possible if electrostatic gap-assisting field 26 were not present. In addition to the primary contribution of providing the desired layer thickness on web 28, gap 18 in FIG. 1 must be large enough to accommodate such things as web splices and foreign matter so that such splices or matter do not come into contact with applicator 16 and thereby adversely affect web coating quality.

Figure 2:
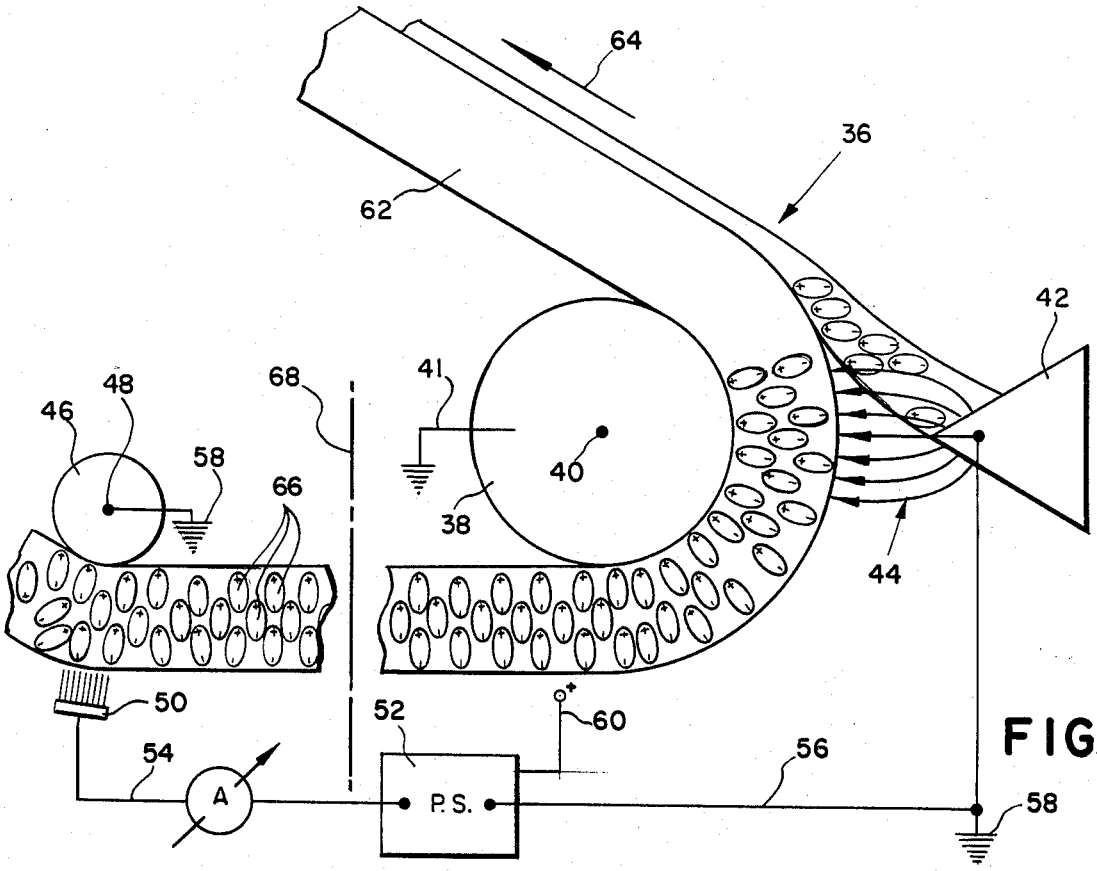
FIG. 2 is a schematic diagram of electrostatic coating-gap assist apparatus of the type that places an electrostatic charge on the material to be coated before it applies coating fluid to said material.

Another type of electrostatically assisted coating apparatus that is the subject of my above-cited copending patent application, is schematically illustrated in FIG. 2. In FIG. 2, numeral 36 generally indicated web coating apparatus employing a precharged web coating technique. In FIG. 2, web support or backing roller 38 is cylindrically shaped, is electrically conductive, is mounted for rotation about backing roller axis 40 and for safety purposes is electrically grounded through path 41 to prevent said roller from operating like a high potential producing Van de Graff generator. Coating applicator 42 is mounted in a fixed position with respect to backing roller 38 and is spaced from said roller 38 by distance or gap 44. Grounded web support or backing roller 46 is cylindrically shaped, is electrically conductive and grounded, and is mounted for rotation about backing roller axis 48. Conductive bristle brush 50 is mounted in a fixed position with respect to and has the free ends of its bristles pointed toward and spaced from said grounded backing roller 46. DC power supply 52 has its high voltage output terminal connected to one end of each of the bristles of said conductive bristle brush 50 through path 54 and has its low voltage output terminal connected to grounded backing roller 46 through path 56 and common ground points 58.

When power supply 52 is energized through path 60, a relatively intense electrostatic field is established between the free ends of the bristles of said conductive bristle brush 50 and roller 46 with a relatively low voltage as explained in much greater detail in my copending U.S. patent application Ser. No. 183,326, filed Sept. 2, 1980, now U.S. Pat. No. 4,402,035 which disclosure is hereby incorporated by reference. A similar but more limited disclosure of a conductive bristle brush electrostatic charge controlling technique is contained at page 70 in the February 1980 issue of Research Disclosure.

As charge-retaining web 62 is moved in direction 64 through the relatively intense electrostatic field established between energized conductive bristle brush 50 and grounded backing roller 46 by drive means (not shown), an electrostatic charge of a predetermined magnitude is established on said web 62. This electrostatic charge results from the orientation of dipoles in web 62 (such as oriented dipoles 66) that were so oriented when web 62 was moved through the electrostatic field between the free ends of conductive bristle brush 50 and roller 46. Conductive bristle brush 50 and backing roller 46 may be spaced a considerable distance from applicator 42 and its associated backing roller 38 as schematically emphasized by the artificial break in web 62 and by partition 68 passing through said artificial break because of the relative stability of the charge placed on web 62 by brush 50.

Figure 3:
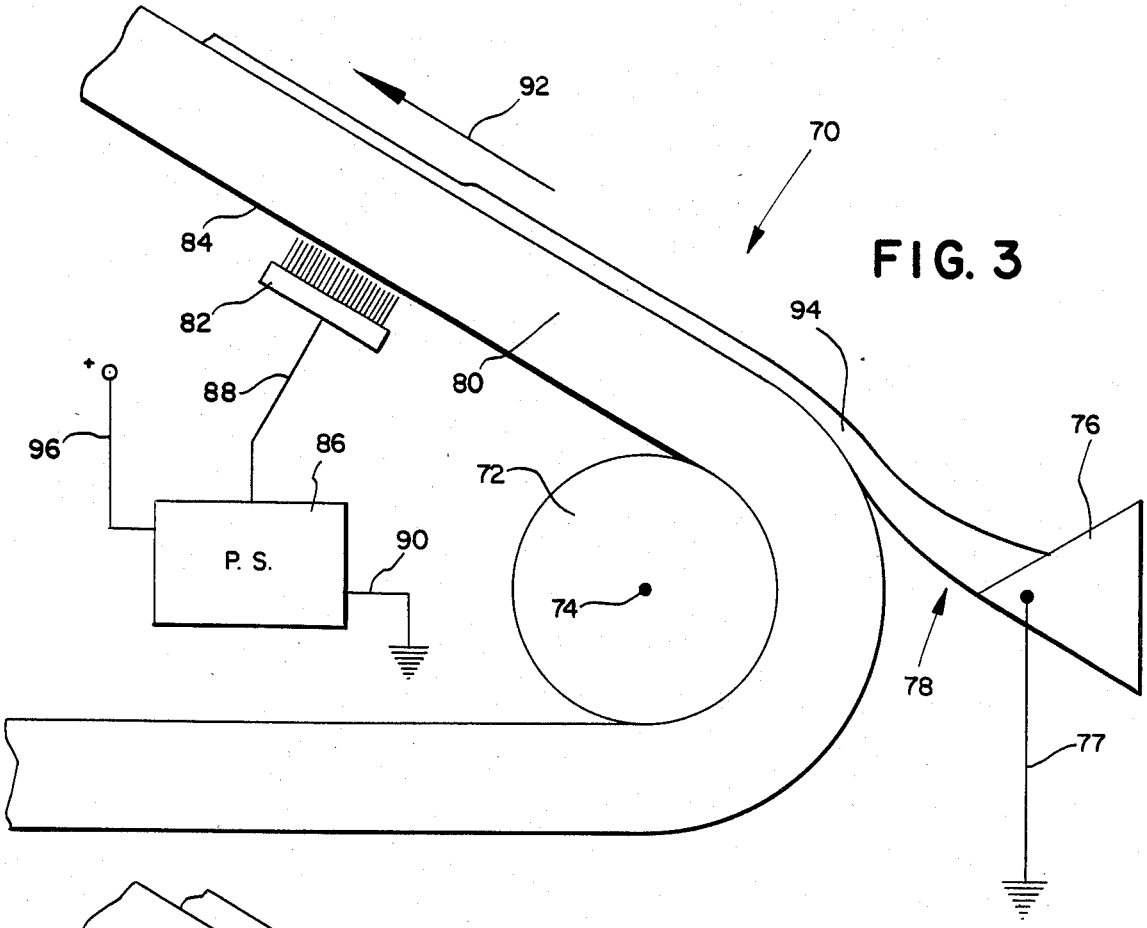
FIG. 3 is a schematic diagram of apparatus employing web coating uniformity improvement apparatus in accordance with the present invention.

Undesirable residual electrostatic charges will normally remain on a material that has been coated by means of electrostatically assisted coating apparatus such as those described above and schematically illustrated in FIGS. 1 and 2. Even if such electrostatic charge producing coating apparatus are not employed, coating uniformity can be adversely affected by electrostatic charges present on coated material produced by other means such as by handling or by a coating machine, as said material is routed through same for coating purposes. In FIG. 3 a coated web is illustrated that is assumed to have this undesirable electrostatic charge thereon. The primary significance of this charge is the detrimental effects that it has on such things as coating thickness and/or surface uniformity and not the actual mechanism that produced such a charge.

Turning to FIG. 3, numeral 70 generally indicated web coating apparatus employing coating uniformity improvement means constructed in accordance with the present invention. In FIG. 3, web support or backing roller 72 is cylindrically shaped, is electrically conductive and is mounted for rotation about backing roller axis 74. Backing roller 72 may or may not be grounded depending upon whether or not an electrostatically assisted coating technique is employed and if employed, the particular type of electrostatic assist technique selected. Coating applicator 76 is electrically grounded through either the coating fluid conduit (not shown) or through path 77, is mounted in a fixed position with respect to backing roller 72 and is spaced from said roller 72 by distance or gap 78. An intermediate portion of elongated sheet or web of charge retaining material 80 is supported by backing roller 72 in said gap 78 in a spaced relation from said applicator 76. Conductive bristle brush 82 is mounted in a fixed position with respect to, and has the free ends of its bristles spaced from surface 84 of said web 80. DC power supply 86 has its high voltage output terminal connected to one end of each of the bristles of said conductive brush 82 through path 88 and has its low voltage output terminal electrically grounded through path 90.

As charge-retaining material or web 80 is moved in direction 92 through coating gap 78, coating fluid 94 is deposited on said web 80 by coating fluid applicator 76. The coating process may or may not be assisted by an electrostatic field. However, under normal conditions a substantially larger residual electrostatic charge and substantially greater change in coating fluid properties will be present in a coated material and its coating, respectively, when an electrostatic field is employed in a web coating process than when such a field is not so employed.

When power supply 86 is energized through path 96, a relatively intense electrostatic field is established between the free ends of the bristles of said conductive bristle brush 82 and electrically conductive coating fluid 94 grounded through applicator 76 and its associated fluid-transporting conduit (not shown), or through path 77, when a portion of coating material 94 is eventually moved into the vicinity of brush 82 by moving web 80 to which it has been applied. The reason that an intense electrostatic field is produced by a conductive bristle brush such as brush 82 is explained in much greater detail in the above-cited copending U.S. patent application. The method of application and the effects of the electrostatic field established between brush 82 and coating fluid 94 on said fluid 94 are schematically illustrated in FIG. 4.

Figure 4:
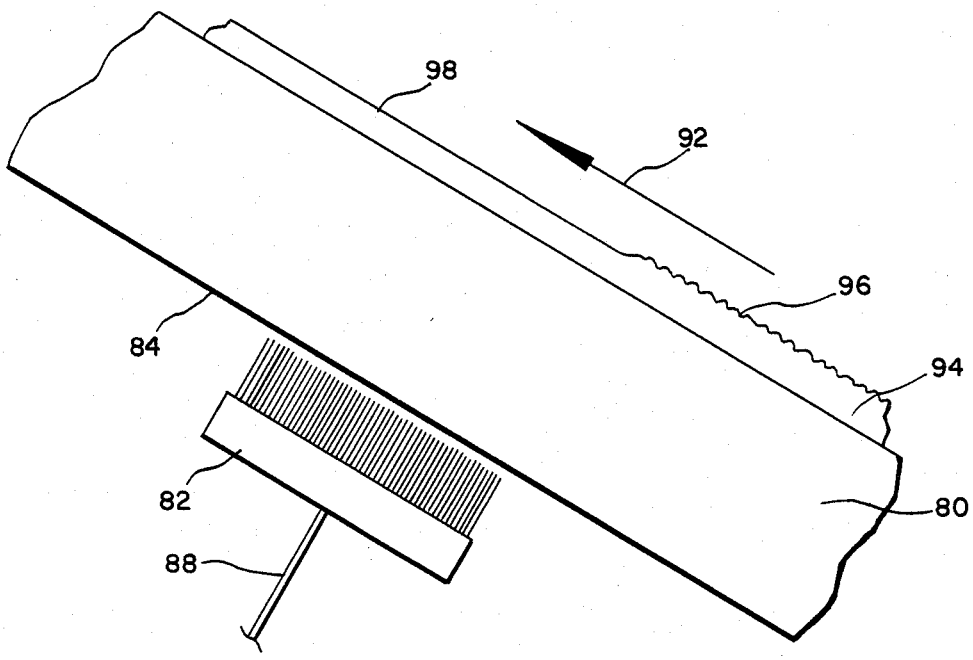
FIG. 4 is an enlarged detail of the electrostatic field producing conductive bristle brush of FIG. 2 and a portion of the coated material in said FIG. 3 having its coating uniformity improved by the electric field established between said brush and the coating material.

Turning now to FIG. 4, which is an enlarged detail of energized conductive bristle brush 82 and a portion of coated web 80 immediately adjacent said brush 82, said coated web 80 is moved in direction 92 through the electrostatic field established between said brush 82 and coating fluid 94 on said web 80. As shown in said FIG. 4, surface 96 of coating fluid 94 is relatively uneven or nonuniform after it has been applied to web 80 but before coating fluid 94 with its said nonuniform surface 96 is subjected to the electrostatic field of brush 82. The magnitude and polarity of this electrostatic field is normally established empirically and is primarily determined by the type of material to be coated and the type coating material to be applied.

When web 80 together with coating 94 moves in direction 92 through the electrostatic field between brush 82 and coating fluid 94 while said coating fluid 94 is still in its fluid state, relatively nonuniform surface 96 of said coating fluid 94 is transformed into relatively uniform surface 98 by the electrostatic field of said brush 82. The electrostatic field of brush 82 changes the electrostatic charge level on charge-retaining web 80 and it is believed, changes the surface tension of coating fluid 94 while said coating fluid is still in its fluid state thereby increasing coating fluid fluidity and decreasing surface roughness or nonuniformity by reason of the increased coating fluid flow resulting from the said brush 82 electrostatic field-produced change in coating fluid 94 fluidity.

DISCUSSION

The electrostatic field associated with brush 82 in the coating uniformity improvement apparatus of the present invention must be positioned such that it interacts with the charge retaining material having the residual electrostatic charges that adversely affect coating fluid surface uniformity. With respect to sheet of charge-retaining material 80 schematically illustrated in FIG. 3, the free ends of conductive bristle brush 82 are optimally located adjacent surface 84 of said sheet 80 which is the side that is directly opposite the side on which coating material 94 is located. In this position the electrostatic field established between brush 82 and coating fluid 94 can most effectively change the electrostatic charge level on web 80 and it is believed, change such properties as the surface tension of coating fluid 94.

The web coating uniformity improvement apparatus of the present invention employs the electrically conductive coating material itself as a ground or electrically conductive reference member in conjunction with a conductive bristle brush to establish the desired charge-controlling electrostatic field. This use of coating fluid 94 is necessary because the coating fluid is necessarily in its fluid state when it is subjected to the electrostatic field of brush 82 for coating improvement purposes and if an alternate reference or ground member were employed it would adversely effect coating fluid thickness and surface quality if it were placed in contact with the coating fluid while said fluid was still in its said fluid state.

When a potential difference is established between brush 82 and coating fluid 94 in, for example, FIG. 3, said brush 82 is sometimes referred to herein as an electrode. Also the term "electrostatic field" employed herein means one species of electric field.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. Coating apparatus comprising:

means for depositing a wet coating on one surface of a web of charge-retaining material as it is advanced along a given path, said web having a residual charge following said coating deposition; and means spaced downstream of said depositing means, at a point wherein said coating still remains wet, for altering said residual charge of said web to enhance redistribution of the still wet coating and thereby improve its uniformity.

2. The invention of claim 1 wherein said means for altering said residual charge includes an electrode mounted at said point downstream in adjoining relation to the opposite surface of said web, and means for applying an electric field between said electrode and said coating.

3. The invention of claim 2 wherein said depositing means includes dipole charging of said web prior to or during deposit of said coating which results in a residual dipole charge remaining after deposit of said coating, and said means for altering said residual charge includes means for applying an electrostatic field between said electrode and said coating to reduce said residual charge.

4. The invention of claim 2 wherein said coating is a conductive coating, said depositing means includes an applicator arrangement having at least a conductive portion thereof which defines the polarity and charge of said coating as it is deposited on said web, and said means for applying an electric field includes means for coupling an electric field between said electrode and said conductive portion of said applicator.

5. The invention of claim 4 wherein said depositing means includes electrostatic dipole charging of said web prior to or during deposit of said coating which results in a residual dipole charge remaining after deposit of said coating, and said means for altering said residual charge includes means for applying an electrostatic field between said electrode and said coating to reduce said residual charge.

6. Apparatus for improving the uniformity of a wet coating deposited by an applicator arrangement on one surface of a moving web of charge-retaining material which retains residual charges following deposition, said apparatus comprising an electrode mounted in adjoining relation to the opposite side of said web downstream of the applicator arrangement at a point wherein said coating still remains wet, and means for applying a potential to said electrode to reduce the residual charge of said web and thereby enhance redistribution of the still wet coating so as to improve its uniformity.

7. The invention of claim 6 wherein coating is deposited by means of dipole charging of said web which results in a residual dipole charge of said web following such deposition, said coating is a conductive coating, and said means for applying a potential to said electrode includes means for applying a potential between said electrode and said conductive coating to produce an electrostatic field therebetween at the downstream point.

8. The invention of claim 6 wherein said applicator arrangement includes a conductive portion determining the polarity and charge of said coating as it is deposited on said web and said means for applying a potential includes means for applying a potential between said electrode and said conductive portion of said applicator arrangement.

9. The invention of claim 8 wherein said potential of said electrode is more positive than the potential of said applied coating.

10. The invention of claim 8 wherein said potential of said electrode is more negative than the potential of said applied coating.

11. The invention of claim 8 wherein said electrode comprises a conductive bristle brush.

* * * * *